United States Patent [19]

Funk

[11] Patent Number: 4,918,882

[45] Date of Patent: Apr. 24, 1990

[54] GLAZING RETAINER ASSEMBLY

[75] Inventor: Murrell N. Funk, Houston, Tex.

[73] Assignee: Texas Aluminum Industries, Inc., Houston, Tex.

[21] Appl. No.: 287,725

[22] Filed: Dec. 21, 1988

[51] Int. Cl.[5] ..... E04B 1/32

[52] U.S. Cl. ..... 52/86; 52/92; 52/200; 52/235; 52/397

[58] Field of Search ..... 52/90, 92, 200, 208, 52/235, 399–400, 86

[56] References Cited

U.S. PATENT DOCUMENTS 3,844,087 10/1974 Schultz et al. ..... 52/200
4,055,923 11/1977 Biebuyck ..... 52/235
4,069,627 1/1978 Pegg ..... 52/92
4,455,798 6/1984 Tsakiris ..... 52/200
4,671,027 6/1987 Esposito ..... 52/90 X

*Primary Examiner*—Richard E. Chilcot, Jr.
*Attorney, Agent, or Firm*—A. Triantaphyllis

[57] ABSTRACT

A glazing assembly for providing a glazing surface for glass or similar media used in the construction of metal and glass structures. The assembly includes a main beam, a mullion bar attached to the main beam, glazing retainers removably attached to the main beam, and glazings attatched to the glazing retainers and to the mullion bar. The glazings form a glazing surface on the same plane. Glass or similar media are attached to the glazing surface.

9 Claims, 6 Drawing Sheets

GLAZING RETAINER ASSEMBLY

TECHNICAL FIELD OF THE INVENTION

The present inventions relates to the field of metal and glass structures such as solariums and greenhouses, and more particularly, to a glazing assembly for providing a support glazing surface for glass or other transparent media used in such structures. Still more particularly, the present invention discloses an assembly comprised of a main beam, a horizontal mullion bar connected to the main beam, a glazing retainer being removably attachable to the main beam, a first glazing being connected to the glazing strip retainer, and a second glazing being connected to the mullion bar, the first and second glazings strip being on the same plane for providing a support glazing strips surface for the glass or similar medium.

BACKGROUND OF THE INVENTION

Metal and glass structures such as solariums and greenhouses are well-known in the art. Furthermore, solariums and greenhouses being attached to a house or similar building structures are also well-known in the art. In general, these solariums or greenhouses are comprised of a roof being connected to the building structure, a front vertical wall, and two side walls, one end of each side wall being connected to the building structure. Main beams extend from the building structure in a general horizontal or slightly pitched direction to form the frame for the roof. Similar main beams extend vertically from the roof to the floor to form the front wall and the side walls. Horizontal mullion bars which are spaced apart extend across the main beams in a general perpendicular configuration with respect to the main beams. Glazing strips comprised of an elastomeric material are attached to the main beams and the mullion bars, and the glass or similar media are placed on those glazing strips and are securely attached thereon by well-known means.

In the past, the mullion bars were connected to the main beam by milling a notch from the main beam to form a recess for receiving the mullion bar. The milling process is time consuming. Furthermore, if an error is made in the milling process as to the location of the recess, the beam is oftentimes unusable and must be scrapped. If the error is discovered at the installation site, the installation is delayed.

According to the present invention, a glazing assembly for connecting the main beams and the mullion bars is disclosed which does not require the milling of the main beam to form a recess thereon, thereby reducing the labor costs, the period of installation of said structures, and eliminating the probability of error.

These and other advantages of the present invention will become apparent from the following description and drawings.

SUMMARY OF THE INVENTION

Accordingly, the present invention provides a glazing assembly for providing a glazing surface for glass or similar media used in structures comprised of metal and glass or similar media such as solariums, greenhouses, etc. The greenhouse glazing assembly includes a main beam having elongate beam channels on the exterior surface of the beam extending throughout substantially the entire length of the beam; glazing retainers having a flange compatible with the channels of the main beam and an elongate glazing strips retainer channel with retaining lips; a mullion bar having a flat plate and two elongate mullion bar channels with retaining lips; and glazings comprised of flexible material having a flat portion and a flange extending therefrom. The flange is compatible with the glazing retainer channel and the mullion bar channels.

In the assembled position, the flat portion of the mullion bar is placed over the side of the main beam having the beam channels. Glazing retainers are placed in the beam channels on both sides of the mullion bar, and glazing strips are placed in the glazing retainer channels and in the mullion bar channels. In that configuration, the flat portions of the glazing strips are on the same plane and form a glazing surface for receiving a glass or similar medium.

A series of these assemblies between main beams and mullions form a plurality of frames in the roof and in the walls of the structure for receiving a plurality of glass plates or similar media. The mullion bars are secured to the main beam by screws or similar means. The glass plates or similar media are secured on the assembly by well known means such as retaining caps which are securely attached to the main beams and the mullion bars by screws or similar means.

DESCRIPTION OF THE DRAWINGS

For a detailed description of the invention, reference will now be made to the accompanying drawings, wherein.

DESCRIPTION OF THE PREFERRED EMBODIMENT

According to the present invention, a glazing assembly is disclosed which includes a main beam, a glazing retainer being removably attachable to the main beam, a first glazing strip being removably attachable to the glazing retainer, a mullion bar being removably attachable to the main beam, and a second glazing strip being removably attachable to the mullion bar. The first and second glazing strips are on the same plane for providing a glazing surface for a glass plate or similar medium.

Figure 1:
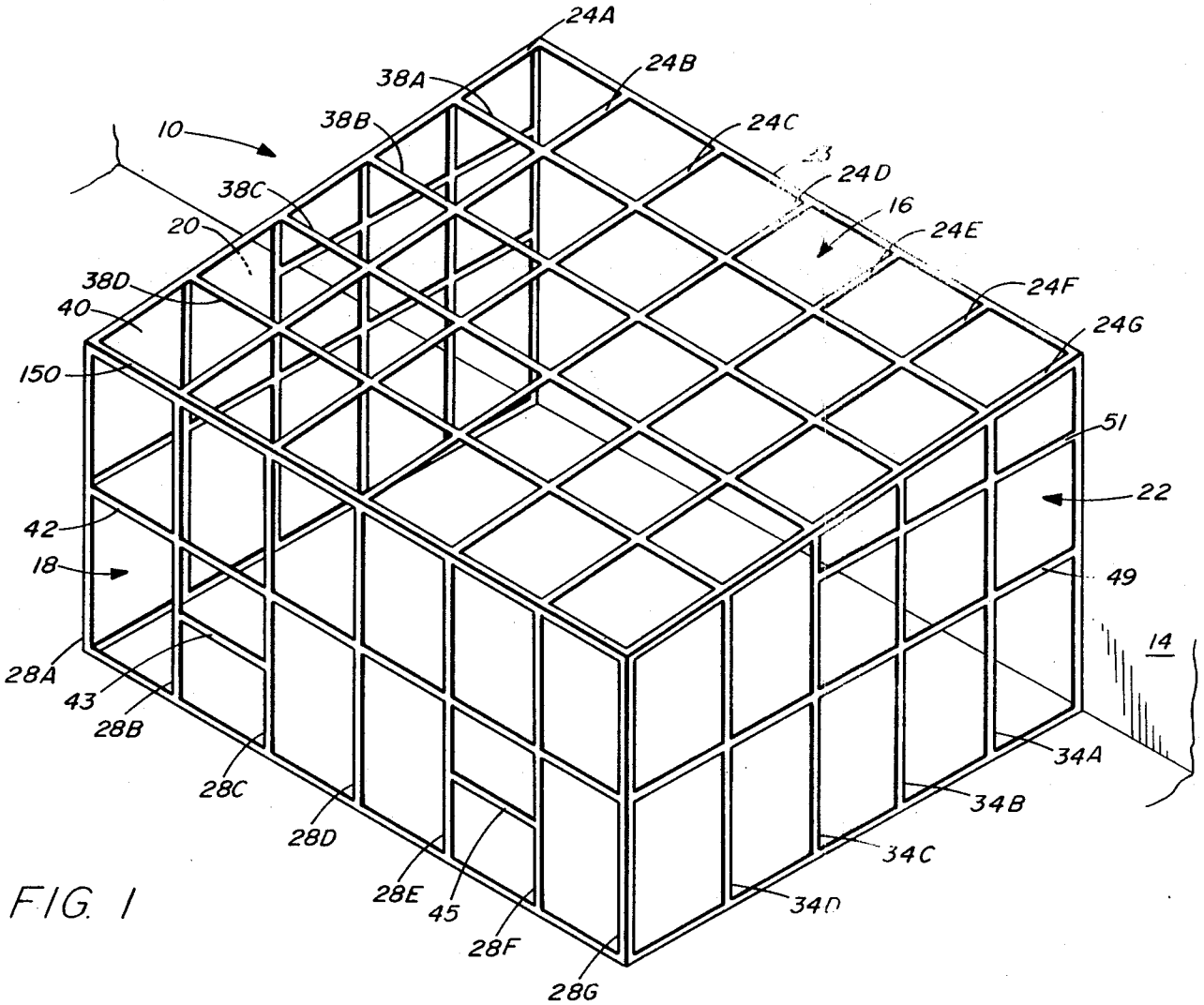
FIG. 1 is a perspective view of a solarium incorporating an assembly according to the present invention.

Referring now to FIG. 1, there is shown a general representation of a solarium 10 being attached to a wall 14 of a house (not shown). Solarium 10 includes a slightly pitched roof 16, a front wall 18, and symmetrical side walls 20 and 22. An attaching beam 23 attaches roof 16 to wall 14. Roof 16 includes roof main beams 24A through 24G extending from attaching beam 23 to the top of front wall 18. Front wall 18 includes vertical front wall main beams 28A through 28G extending from the front end of roof main beams 24A through 24G, respectively, to the floor of solarium 10. Side wall 22 includes vertical side wall main beams 34A through 34E which extend from roof 16 to the floor of solarium 10. Side wall 20 which is symmetrical to side wall 22 has similar side wall beams.

Spaced apart horizontal mullion bars 38A through 38D extend from roof main beam 24A to roof main beam 24G and are attached to roof main beams 24A through 24G, as hereinafter described. A horizontal eave mullion bar 150 extends from roof main beam 24A to roof main beam 24G along the top of front wall main beams 28A through 28G, and is attached to roof main beams 24A through 24G and front wall main beams 28A through 28G, as hereinafter described. Mullion bars 38A through 38D, eave mullion bar 150, attaching beam 23, and roof main beams 24A through 24G form a plurality of frames that provide a glazing surface for a plurality of glass plates, one of which is shown as glass plate 40. Although only one glass plate 40 is designated as such in FIG. 1, it should be understood that the remaining glass plates on roof 16 are referred to herein also as glass plates 40.

A horizontal mullion bar 42 extends from front wall main beam 28A to front wall main beam 28G, and is connected to front wall main beams 28A through 28G, as hereinafter described. A mullion bar 43 extends from front wall main beam 28B to front wall main beam 28C. Another mullion bar 45 extends from front wall main beam 28E to front wall main beam 28F. Front wall main beams 28A through 28G, eave mullion bar 150, and mullion bars 42, 43, and 45 form a plurality of frames for supporting a plurality of glass plates on front wall 18.

Side wall 22 includes a horizontal mullion bar 49 extending from side wall main beam 34A to front wall main beam 28G. Mullion bar 49 is attached to side wall main beams 34B through 34E, as hereinafter described. Another mullion bar 51 extends from side wall main beam 34A to side wall main beam 34D. Mullion bar 51 is attached to side wall main beams 34B and 34C. Side wall main beams 34A through 34E, mullion bars 49 and 51, roof main beam 24G, and front wall main beam 28G form a plurality of frames for a plurality of glass plates or windows, and, if desired, one or more doors. Side wall 20 is similar to side wall 22. Further description of side wall 20 is not necessary to avoid repetition.

Figure 2:
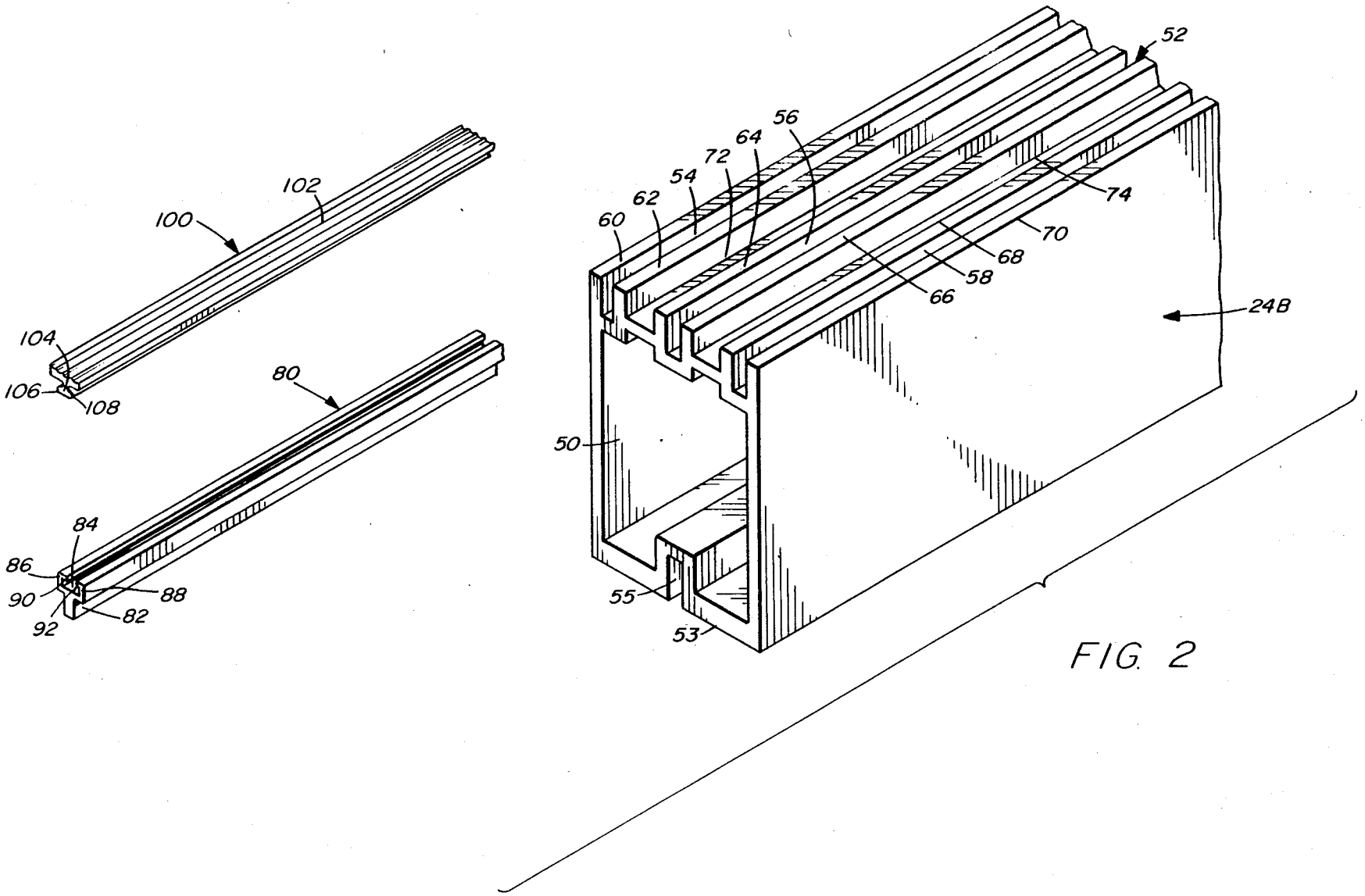
FIG. 2 is an exploded perspective view showing a glazing retainer, a glazing strip, and a portion of a main beam used in connection with the assembly of the present invention.

Referring now to FIG. 2, there is shown a portion of roof main beam 24B. It should be understood, however, that the following description applies also to any of the other main beams referred to above, namely, roof main beams 24A and 24C through 24G, front wall main beams 28A through 28G, side wall main beams 34A through 34E, and the side wall main beams of side wall 20. Furthermore, it should be understood that although the description applies to all said main beams, the dimensions of some of the main beams may be different when compared to the other main beams because of the particular position, application or use of the main beams.

Main beam 24B is a rectangular beam having a hollow interior 50. Top side 52 of main beam 24B includes three parallel channels 54, 56 and 58 extending throughout the entire length (not shown) of main beam 24B. The sides of channels 54, 56 and 58 have teeth (not shown) so that channels 54, 56 and 58 may serve as screw bosses. Channel 54 has walls 60 and 62, channel 56 has walls 64 and 66, and channel 58 has walls 68 and 70. Walls 62 and 64 also form a channel 72 therebetween. Similarly, walls 66 and 68 also form a channel 74 therebetween.

Still referring to FIG. 2, there is also shown a glazing retainer 80 having a first portion and a vertical flange 82 which extends from the first portion and is appropriately sized to fit in channels 54 and 58. Glazing retainer 80 also includes a channel 84 having walls 86 and 88 that extend from the first portion, and lips 90 and 92 extending inwardly from walls 86 and 88, respectively.

FIG. 2 also shows a glazing strip 100 constructed of elastomeric material having a flat portion 102 and a vertical flange 104 extending perpendicularly from flat portion 102. Flange 104 includes tongues 106 and 108 extending therefrom. In the assembled position, glazing strip 100 is connected to glazing retainer 80 by inserting flange 104 in channel 84, and is retained therein by a T-slot connection between tongues 106 and 108 and lips 90 and 92, respectively.

Figure 3:
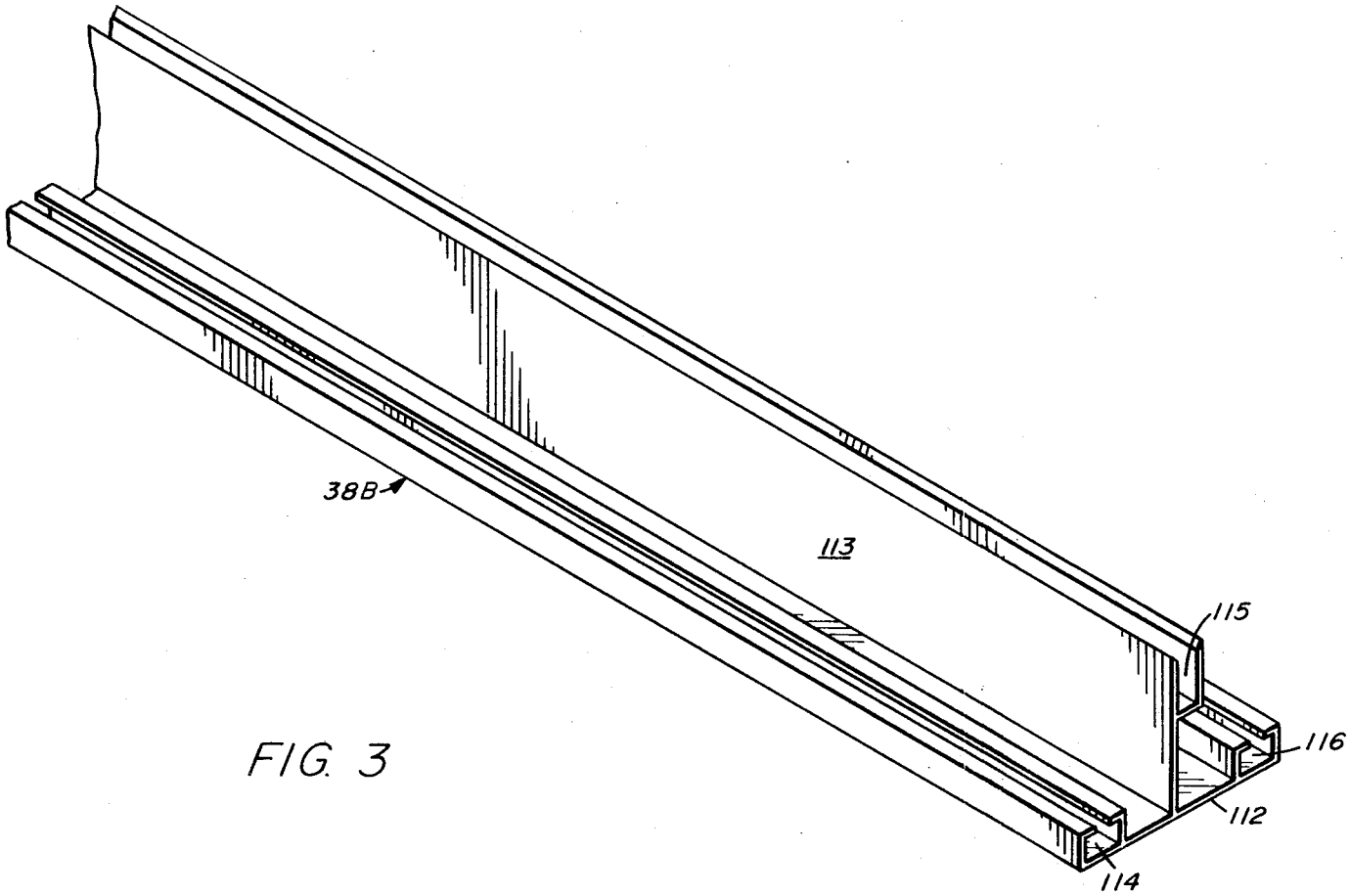
FIG. 3 is a perspective view showing a section of a mullion bar used in connection with the assembly of the present invention.

Referring now to FIG. 3, there is shown mullion bar 38B having a first flat portion 112; elongate channels 114 and 116 extending throughout the entire length of mullion bar 38B on first flat portion 112; a second flat portion 113 extending perpendicularly from first flat portion 112; and a channel 115 formed with an extension from second flat portion 113. Channels 114 and 116 are similar to channel 84 of glazing retainer 80 so that they can similarly receive a glazing strip 100 (shown in FIG. 2). It should be understood that because mullion bar 38B is similar to mullion bars 38A, 38C, 38D, 42, 43, 45, 49, 51 and the mullion bars of side wall 20, the above description of mullion bar 38B is applicable to those mullion bars. It should also be understood, however, that the dimensions of some of these mullion bars are not the same, depending on the position, use or application thereof.

Figure 4:
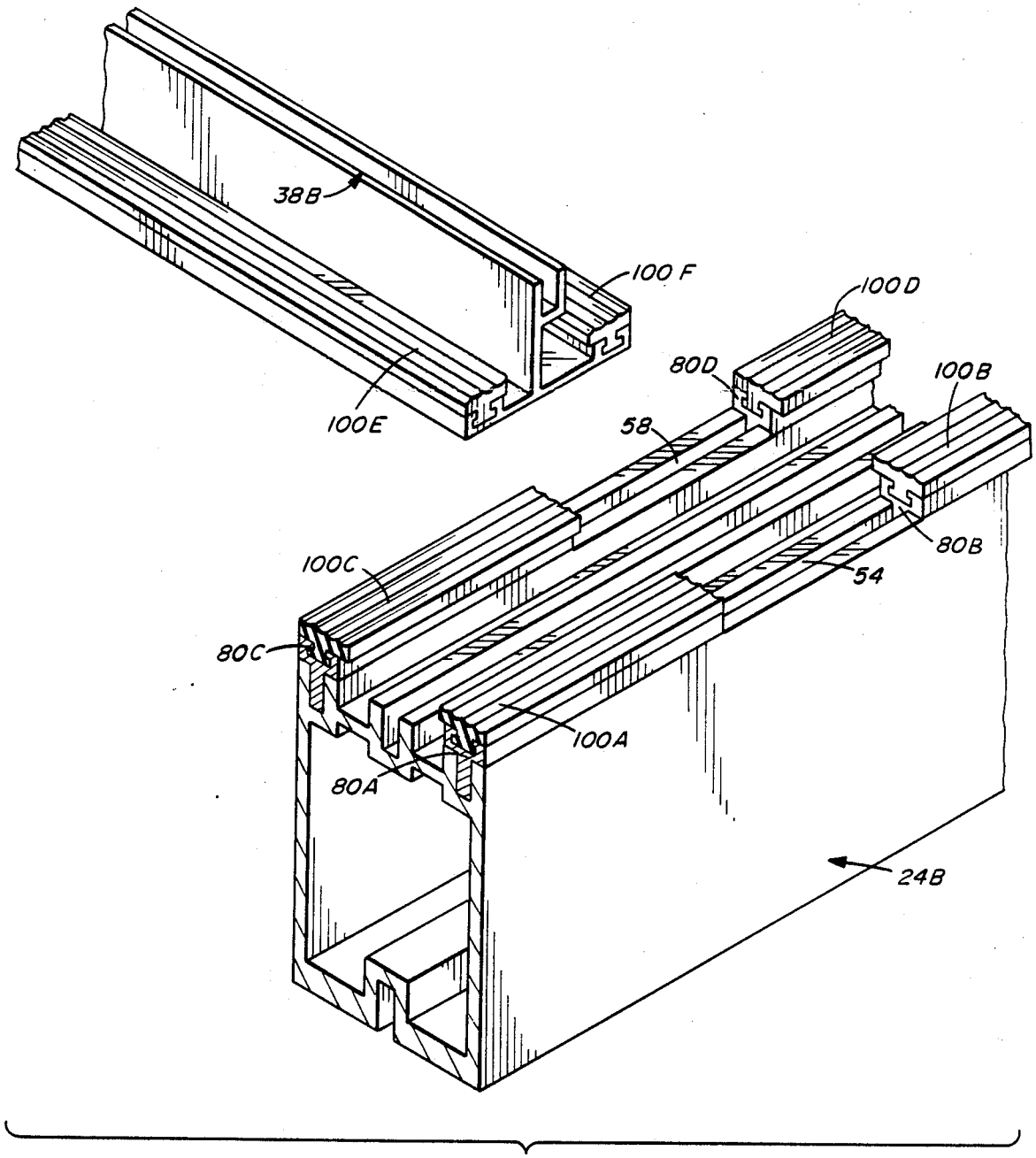
FIG. 4 is a partially exploded perspective view showing a section of the main beam of FIG. 2 connected to sections of glazing retainers and glazing strips similar to the glazing retainer and glazing strip shown in FIG. 2, and a section of the mullion bar shown in FIG. 3 being connected to glazing strips similar to the glazing strip shown in FIG. 2.

Referring now to FIG. 4, there is shown roof main beam 24B. Glazing retainers 80A and 80B, similar to glazing retainer 80, are inserted into channel 54, and glazing retainers 80C and 80D which are also similar to ,glazing retainer 80 are inserted into channel 58. Glazing strips 100A, 100B, 100C, and 100D which are similar to glazing strip 100 are disposed over glazing retainers 80A, 80B, 80C, and 80D, respectively. Spaces are provided between glazing retainers 80A and 80B, and 80C and 80D to receive mullion bar 38B over main beam 24B. Mullion bar 38B has glazings strips 100E and 100F, similar to glazing 100, attached thereto, as described above. Mullion bar 38B is disposed over main beam 24B in the spaces provided between glazing retainers 80A and 80B, and 80C and 80D whereby glazing strips 100E and 100F are on the same plane with glazing strips 100A, 100B, 100C and 100D. The edges of a glass plate 40 (not shown) are then placed on glazing strips 100E and 100A, the edges of another glass plate are placed on glazings 100E, and 100C, the edges of another glass plate are placed on glazing strips 100F and 100B, and the edges of still another glass plate are placed on glazings strips 100F and 100D. The glass plates are securely retained on glazing strips 100A through 100F by appropriate securing means which are well known in the art, such as caps or the like which are securely attached to roof main beam 24B by screw or similar means (not shown). It should be understood that the assembly described in connection with roof main beam 24B and mullion bar 38B is similar to the assemblies between the remaining roof main beams, i.e. main beam 24A, and 24C through 4G, and the remaining roof mullion bars, i.e. mullion bars 38A, 38C and 38.

Figure 5:
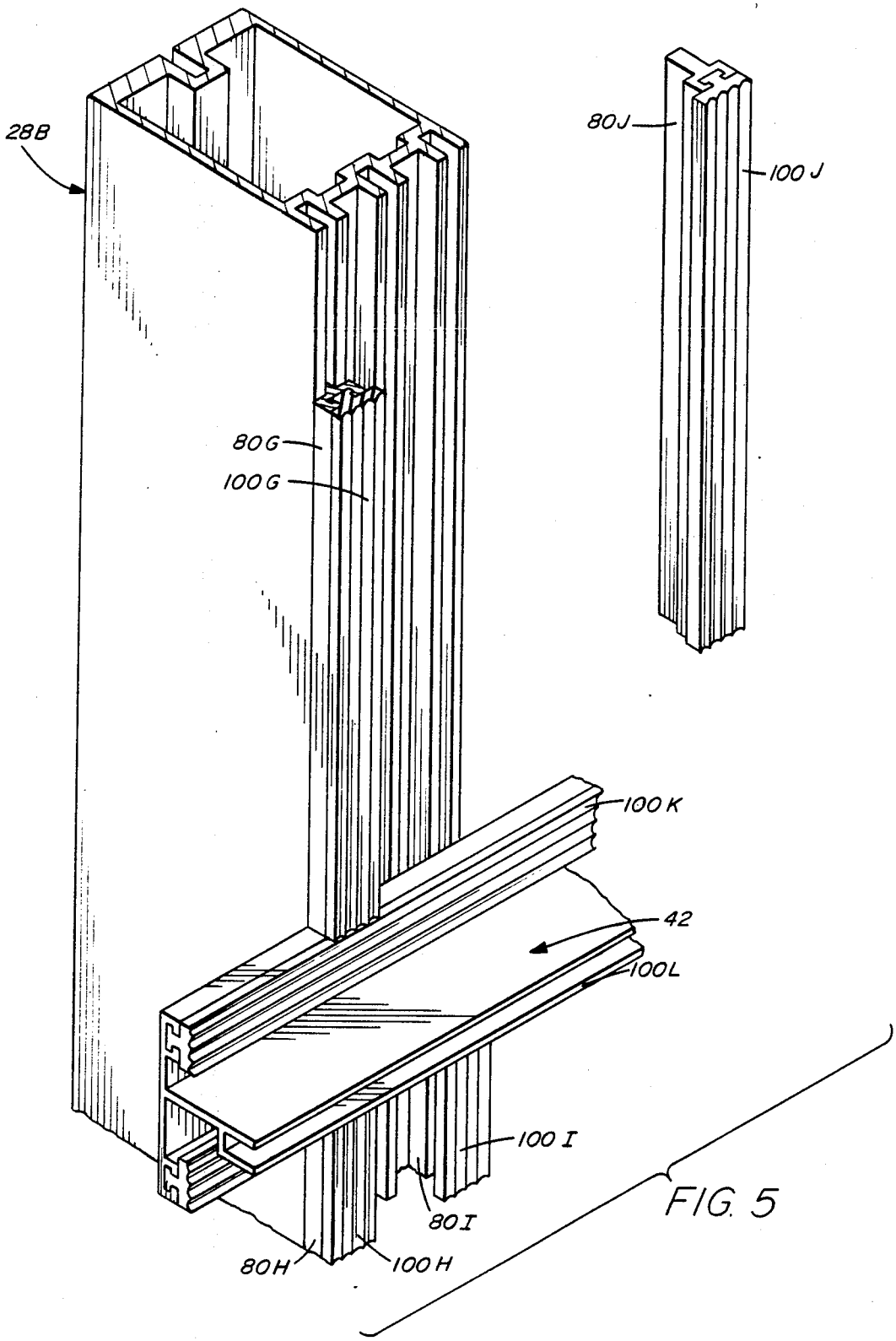
FIG. 5 is a partially exploded perspective view of a section of a main beam similar to the main beam shown in FIG. 2 being connected to glazing retainers and glazing strips similar to the glazing strip retainer and the glazing shown in FIG. 2 and to a mullion bar similar to the mullion bar shown in FIG. 3.

Referring now to FIG. 5, there is shown main beam 28B which is similar to main beam 24B. Mullion bar 42 which is similar to mullion bar 38B previously described is attached to main beam 28B. Glazing retainers 80G, 80H and 80I supporting glazing strips 100G, 100H, and 100I, respectively, are attached to main beam 28B like glazing retainers 80A, 80B, and 80D are attached to main beam 24B, as previously described. A glazing retainer 80J having attached thereto a glazing strip 100J is shown prior to similar attachment to main beam 28B. Glazing retainers 80G through 80J are similar to glazing strips retainer 80, and glazings 100G through 100J are similar to glazing strip 100. Mullion bar 42 is securely attached to main beam 28B in the spaces provided between glazing retainers 80G, and 80H, and 80J and 80I by screw means (not shown). Glazing strips 100K and 100L which are similar to glazing strip 100 are inserted in mullion bar 42. The edges, of glass plates (not shown) are attached to glazing strips 100G through 100L. Similar connections are made between the remaining main beams and mullion bars of front wall 18, and between the main beams and the mullion bars of side walls 20 and 22.

Figure 6:
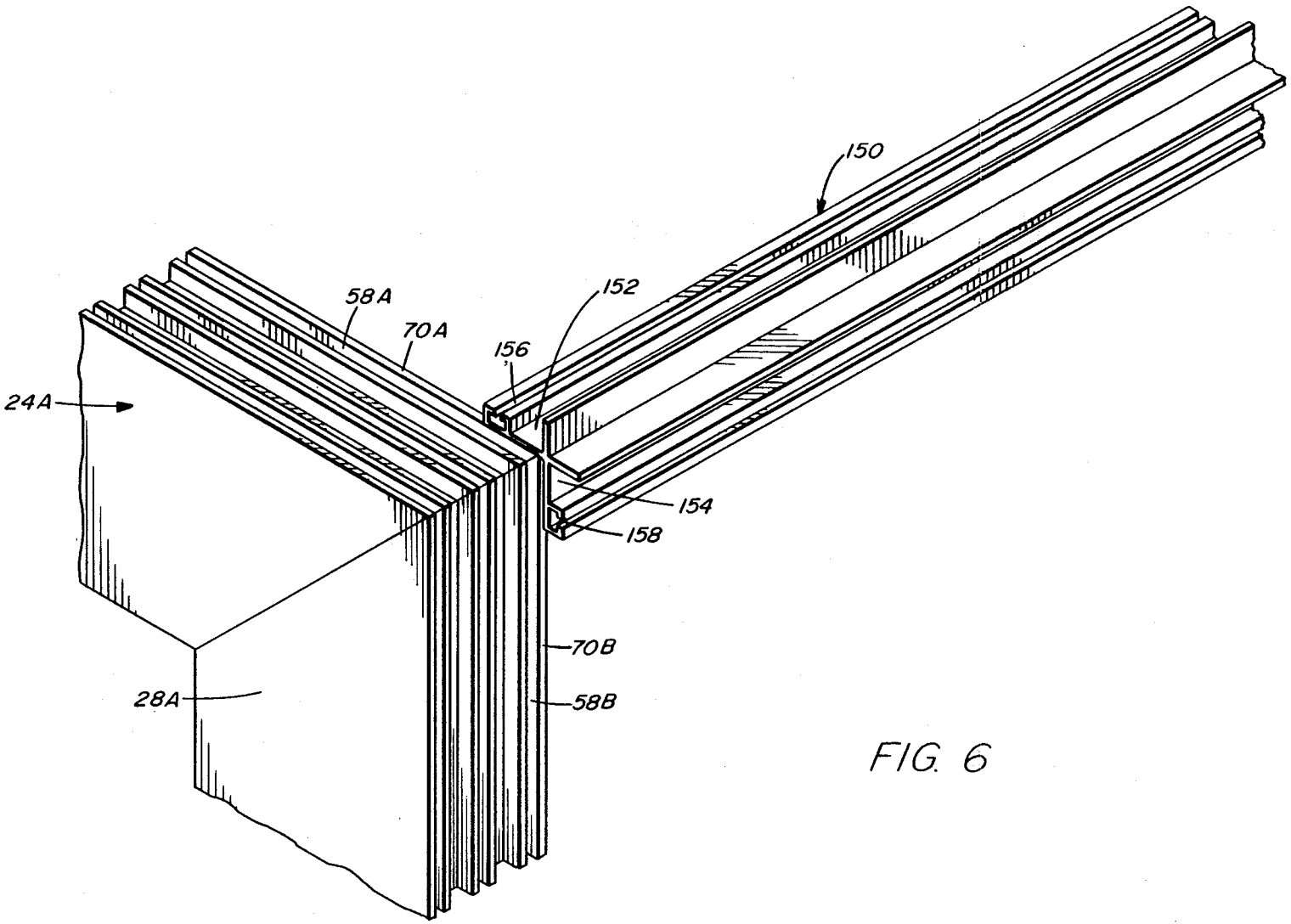
FIG. 6 is perspective view showing sections of two main beams similar to the beam shown in FIG. 2 being connected to an eave mullion bar to form a section of the assembly of the present invention.

Referring now to FIG. 6, there is shown another main beam/ mullion bar connection embodying the present invention. More particularly, there is shown roof main beam 24A being connected to front wall main beam 28A by means well-known in the art. Eave mullion bar 150 has a first flat plate 152 and a second flat plate 154 which is perpendicular to flat plate 152. Plate 152 is attached to the top of wall 70A of channel 58A and plate 154 is attached to the top of wall 70B of channel 58B. Plate 152 includes a channel 156 which is similar to channels 114 and 116 of mullion bar 38B for receiving a glazing strip similar to glazing strip 100 (not shown). Similarly, plate 154 includes a channel 158 which is similar to channel 156 for receiving a glazing strip similar to glazing strip 100 (not shown). Glazing retainers like glazing retainer 80 are inserted in channels 58A and, 58B, as previously described, and glazing strips like glazing strip 100 are inserted in the channels of such glazing retainers and in channels 154 and 156 to provide glazing surfaces for a glass plate 40 (not shown).

The glazing retainers described above are usually cut in the factory. Therefore, exact placement of the mullion bars and adequate clearance for the glass plates at the installation are assured.

All beams, mullion bars and glazing retainers discussed above are constructed of metallic material, preferably aluminum. The glazing strips are constructed of elastomeric material.

The drawings used to demonstrate the invention are not to scale. Furthermore, they do not show actual dimensions of the various components. The dimensions of the components may vary depending on the installation.

It should be understood that, although the present invention utilizing removable glazing retainers to accommodate the connection of main beams with mullion bars without cutting out portions of the main beams has been described in connection with solariums, and more particularly in connection with specific sections of the solariums, the present invention disclosing an assembly utilizing removable glazing retainers should not be limited to those structures or the specific portions thereof; instead the present invention is applicable to all structures utilizing main beams and mullion bars to provide glazing for glass or similar media. Therefore, while preferred embodiments of the present invention have been shown and described, modifications thereof can be made by one skilled in the art without departing from the spirit of the invention.

What is claimed is:

1. An assembly for providing support for a glass or other transparent medium comprising:
- a beam having a first channel;
- a first glazing retainer having a first glazing retainer flange being received in the first channel;
- a first glazing strip being attached to and being supported by the first glazing retainer;
- a mullion bar being connected to the beam; and
- a second glazing strip being attached to the mullion bar, the first and second glazing strips being on the same plane for supporting the glass or other transparent medium.

2. An assembly according to claim 1 further including a second glazing retainer having a second glazing retainer flange being received in the first channel and a third glazing strip being attached to and being supported by the second glazing retainer.

3. A glazing retainer for attaching a glazing strip to a construction beam having a beam channel, comprising:
- a first portion;
- a first wall extending from the first portion;
- a second wall extending from the first portion, the first and second walls, forming, a retainer channel therebetween for receiving the blazing strip; and
- a flange extending from the first portion and being receivable in the beam channel.

4. An assembly for receiving a glazing strip that provides a glazing surface for glass or similar transparent media in building structures, comprising:
- a construction beam having a beam channel; and
- a retainer having means for removably attaching the glazing strip to the retainer and a flange extending from the attaching means, the flange being inserted in the beam channel.

5. An assembly according to claim 4 wherein the retainer includes:
- a first portion; and
- a vertical flange which extends from the first portion, the flange being appropriately sized to fit in the beam channel.

6. An assembly according to claim 5 wherein the first portion includes:
- a first wall;
- a second wall forming a channel with the first wall;
- a first lip extending from the first wall; and
- a second lip extending from the second wall.

7. A glazing retainer according to claim 3 further including:
- a first lip extending from the first wall; and
- a second lip extending from the second wall.

8. An assembly according to claim 1 wherein the first glazing retainer includes a first glazing retainer channel for receiving a portion of the first glazing strip.

9. An assembly for providing support for a glass or other transparent medium on a beam that has a beam channel, comprising:

a first portion;

a first wall extending from the first portion;

a second wall extending from the first portion, the first and second walls forming a retainer channel therebetween;

a first lip extending inwardly from the first wall;

a second lip extending inwardly from the second wall;

a retainer flange extending directly from the first portion and being receivable in the beam channel;

a glazing strip having a flat portion and a vertical glazing strip flange extending from the flat portion, the vertical glazing strip flange being received in the retainer channel.

* * * * *